US011752788B2

(12) United States Patent
Costal Fornells et al.

(10) Patent No.: US 11,752,788 B2
(45) Date of Patent: Sep. 12, 2023

(54) MOVEABLE PRINTHEADS

(71) Applicant: Hewlett-Packard Development Company, L.P., Spring, TX (US)

(72) Inventors: Pau Costal Fornells, Sant Cugat del Valles (ES); Marta Ramis Llinares, Sant Cugat del Valles (ES); Andreas Muller, Barcelona (ES); Oscar Martinez Bailac, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/977,250

(22) PCT Filed: Mar. 22, 2018

(86) PCT No.: PCT/US2018/023803
§ 371 (c)(1),
(2) Date: Sep. 1, 2020

(87) PCT Pub. No.: WO2019/182601
PCT Pub. Date: Sep. 26, 2019

(65) Prior Publication Data

US 2021/0039409 A1 Feb. 11, 2021

(51) Int. Cl.

| | |
|---|---|
| ***B41J 25/00*** | (2006.01) |
| ***B41J 2/045*** | (2006.01) |
| ***B41J 2/145*** | (2006.01) |
| ***B41J 2/21*** | (2006.01) |

(52) U.S. Cl.
CPC ..... *B41J 25/001* (2013.01); *B41J 2/04586* (2013.01); *B41J 2/145* (2013.01); *B41J 2/2117* (2013.01)

(58) Field of Classification Search
CPC ..... B41J 25/001; B41J 2/04586; B41J 2/145; B41J 2/2117
See application file for complete search history.

(56) References Cited

U.S. PATENT DOCUMENTS

| | | | | |
|---|---|---|---|---|
| 4,774,529 | A * | 9/1988 | Paranjpe | B41J 2/2103 347/43 |
| 5,598,192 | A | 1/1997 | Burger et al. | |
| 5,771,050 | A * | 6/1998 | Gielen | B41J 25/34 347/19 |
| 6,109,721 | A | 8/2000 | Kim | |
| 6,299,287 | B1 | 10/2001 | Williams et al. | |
| 6,310,640 | B1 | 10/2001 | Askeland | |

(Continued)

FOREIGN PATENT DOCUMENTS

| | | |
|---|---|---|
| CN | 1169551 | 1/1998 |
| CN | 1346313 | 4/2002 |
| CN | 101607480 | 12/2009 |
| CN | 102205750 | 10/2011 |
| CN | 102343722 | 2/2012 |
| CN | 102490474 | 6/2012 |
| CN | 103552387 A | 2/2014 |

(Continued)

*Primary Examiner* — Thinh H Nguyen

(57) ABSTRACT

An example of a printing carriage system is disclosed. The example disclosed herein comprises a plurality of printheads, and a positioning mechanism. The plurality of printheads comprises a moveable printhead that is moveable with respect to other printheads from the plurality of printheads. The positioning mechanism is to move the moveable printhead from a first printhead position to a second printhead position.

20 Claims, 10 Drawing Sheets

(56) References Cited

U.S. PATENT DOCUMENTS

| | | | | |
|---|---|---|---|---|
| 6,322,197 | B1 * | 11/2001 | Yanaka | B41J 3/543 347/12 |
| 6,367,910 | B1 | 4/2002 | Sette | |
| 6,789,876 | B2 | 9/2004 | Barclay et al. | |
| 6,866,365 | B1 | 3/2005 | Neese et al. | |
| 7,988,251 | B2 | 8/2011 | Dimitrijevic et al. | |
| 8,272,710 | B2 | 9/2012 | Spaulding et al. | |
| 8,651,606 | B2 | 2/2014 | Kakinuma et al. | |
| 2003/0202045 | A1 | 10/2003 | Togerson et al. | |
| 2004/0250760 | A1 | 12/2004 | Goto | |
| 2012/0249679 | A1 | 10/2012 | Beier | |
| 2014/0015881 | A1 | 1/2014 | Veis | |
| 2016/0176189 | A1 | 6/2016 | Sugahara | |

FOREIGN PATENT DOCUMENTS

| | | | |
|---|---|---|---|
| EP | 0693382 | | 1/1996 |
| EP | 1407886 | | 4/2004 |
| EP | 3034179 | A1 | 6/2016 |
| EP | 3061614 | B1 | 8/2016 |
| EP | 3225395 | | 10/2017 |
| JP | H05238004 | | 9/1993 |
| JP | 2007301902 | | 11/2007 |
| JP | 2009113284 | | 5/2009 |
| JP | 2011136507 | | 7/2011 |
| JP | 2012125951 | | 7/2012 |
| JP | 2017104996 | | 6/2017 |
| WO | WO-2014005608 | | 1/2014 |

* cited by examiner

MOVEABLE PRINTHEADS

BACKGROUND

The carriage of a printer is an element within a printing device. The carriage may be the place where the printheads are located. In different printing operations, the printheads in the carriage may be set in different layouts. During a printing operation, the printheads layout in the carriage is fixed and unmovable in the printer.

BRIEF DESCRIPTION OF THE DRAWINGS

The present application may be more fully appreciated in connection with the following detailed description taken in conjunction with the accompanying drawings, in which like reference characters refer to like parts throughout and in which.

DETAILED DESCRIPTION

The following description is directed to various examples of the disclosure. The examples disclosed herein should not be interpreted, or otherwise used, as limiting the scope of the disclosure, including the claims. In addition, the following description has broad application, and the discussion of any example is meant only to be descriptive of that example, and not intended to indicate that the scope of the disclosure, including the claims, is limited to that example. In the following description, numerous details are set forth to provide an understanding of the examples disclosed herein. However, it will be understood by those skilled in the art that the examples may be practiced without these details. While a limited number of examples have been disclosed, those skilled in the art will appreciate numerous modifications and variations therefrom. It is intended that the appended claims cover such modifications and variations as fall within the scope of the examples. Throughout the present disclosure, the terms "a" and "an" are intended to denote at least one of a particular element. In addition, as used herein, the term "includes" means includes but not limited to, the term "including" means including but not limited to. The term "based on" means based at least in part on.

The carriage of a printer is an element within a printer. The carriage may be the element wherein the printheads are located. In different printing operations, the printheads in the carriage may be set in different layouts.

In an example, a printing system carriage is envisaged, the carriage comprising a plurality of printheads including a moveable printhead that is moveable with respect to the other printheads from the plurality of printheads. The printing system carriage may also comprise a positioning mechanism to move the moveable printhead from a first printhead position to a second printhead position.

In another example, a method is disclosed, the method comprising a plurality of operations to be performed. The method comprises the block of receiving a triggering signal. The method also comprises the block of moving, by a positioning mechanism, a position of a moveable printhead from a plurality of printheads from a first printhead position to a second printhead position, wherein the moveable printhead is moveable with respect to the other printheads from the plurality of printheads.

Another example of the present disclosure provides a non-transitory machine readable medium storing instructions executable by a processor. The non-transitory machine readable medium comprises instructions to receive a triggering signal. The non-transitory machine readable medium also comprises instructions to move a position of a moveable printhead from a plurality of printheads from a first printhead position to a second printhead position, wherein the moveable printhead is moveable with respect to the other printheads from the plurality of printheads.

Figure 1:
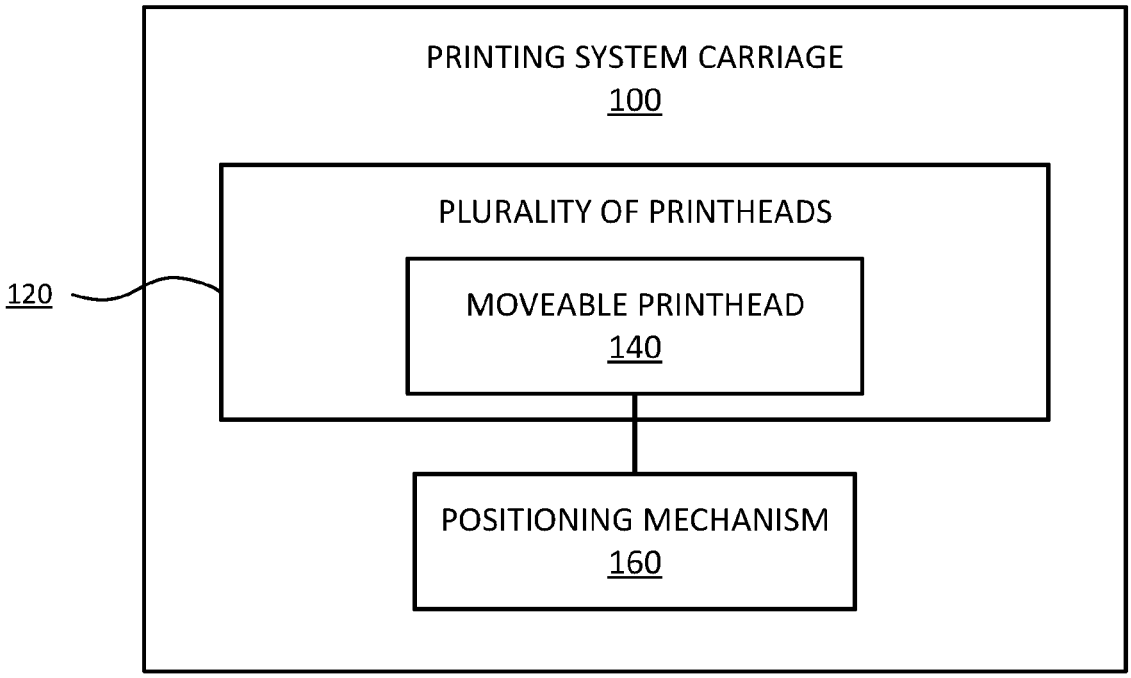
FIG. 1 is a block diagram illustrating an example of a printing system carriage comprising moveable printheads.

Referring now to the figures, FIG. 1 is a block diagram of a printing system 100 carriage comprising moveable printheads according to an implementation. The printing system carriage 100 includes a plurality of printheads 120, and a positioning mechanism 160. The plurality of printheads comprises a moveable printhead 140 that is moveable with respect to the other printheads from the plurality of printheads.

Figure 3A:
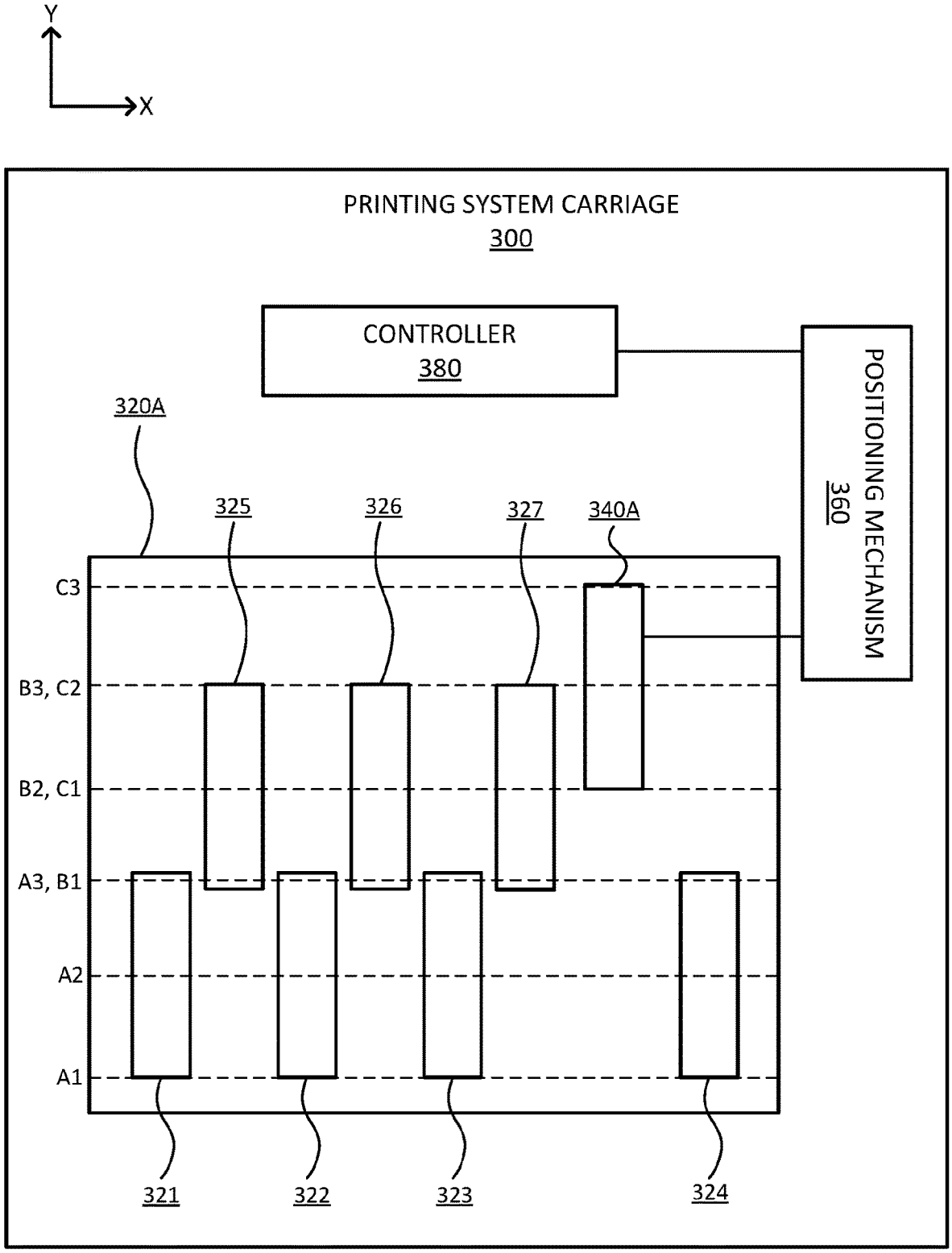
FIG. 3A is a block diagram illustrating another example of a printing system carriage comprising moveable printheads in a first printhead position.
Figure 3B:
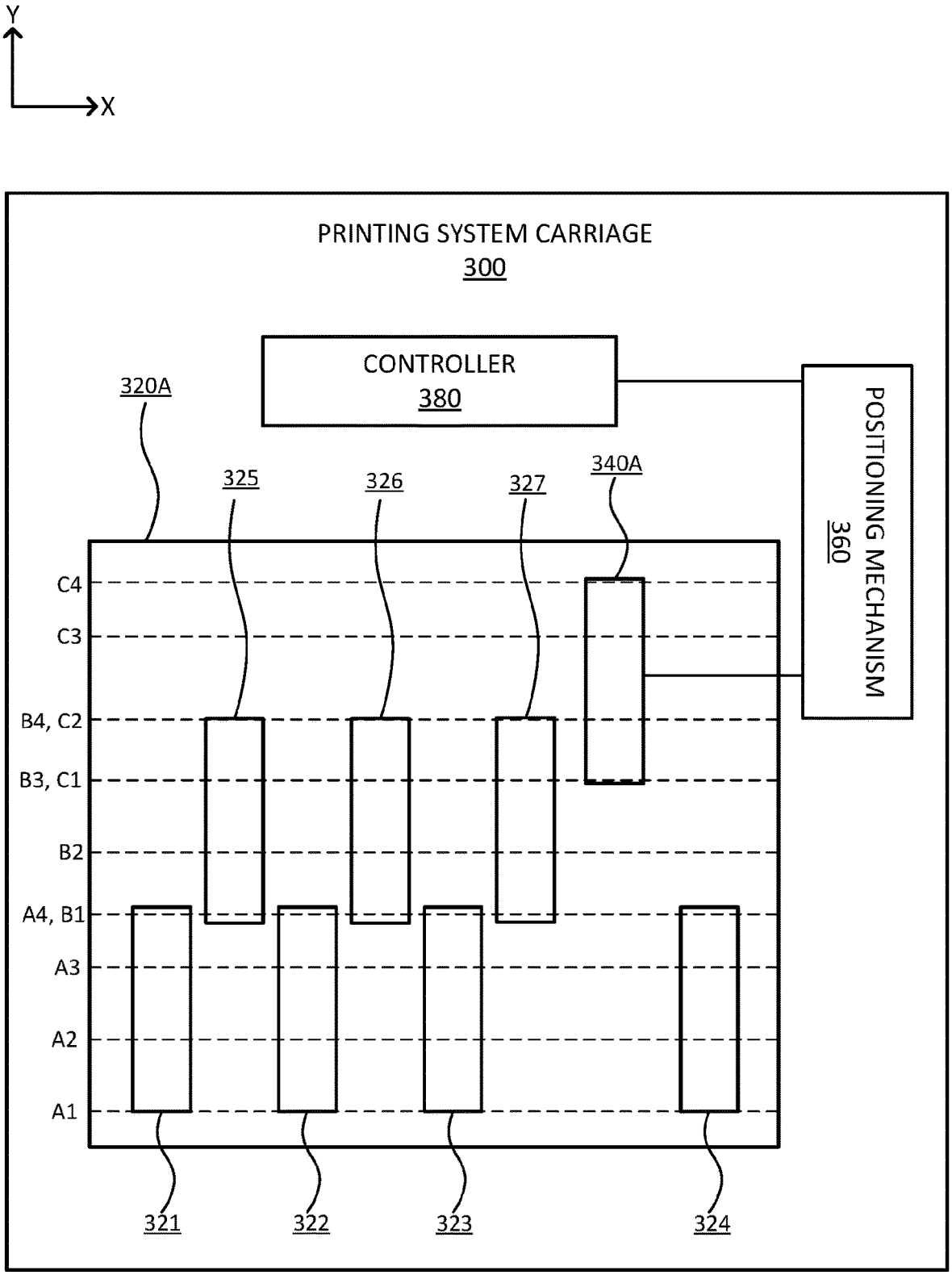
FIG. 3B is a block diagram illustrating another example of a printing system carriage comprising moveable printheads in a second printhead position
Figure 4:
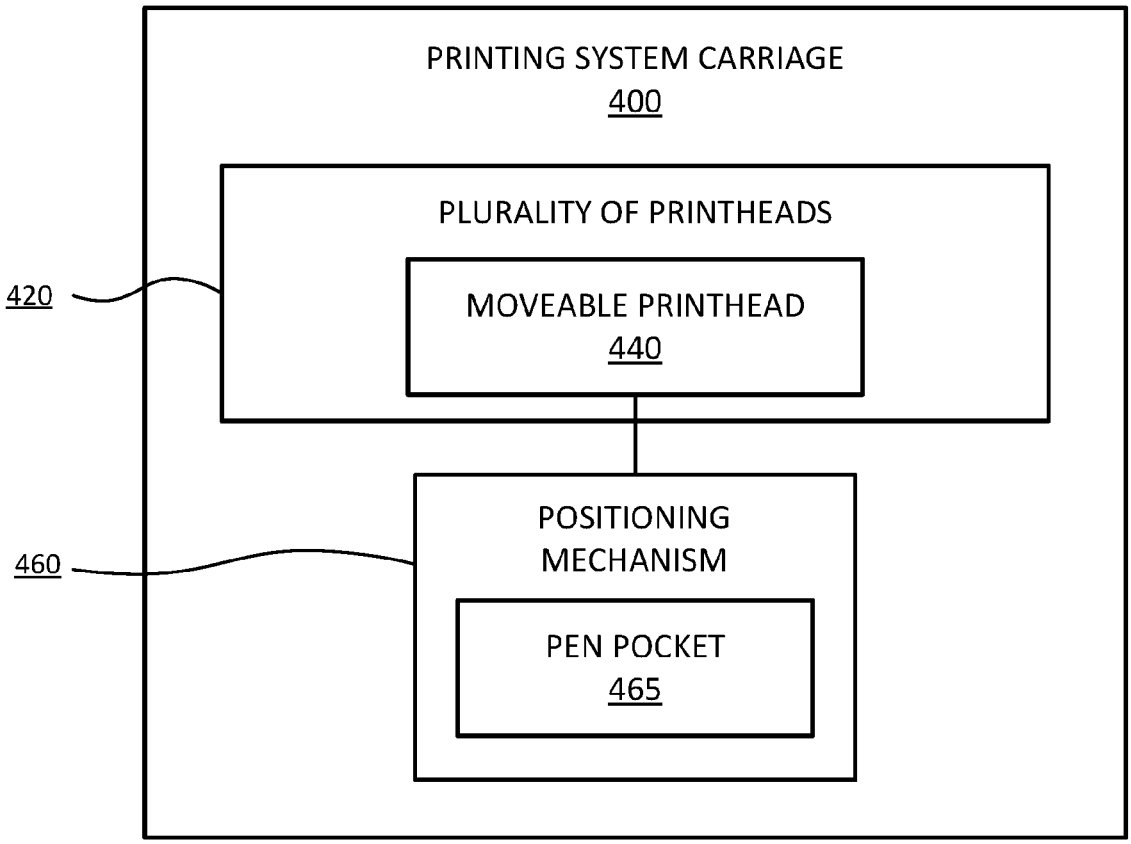
FIG. 4 is a block diagram illustrating another example of a printing system carriage comprising moveable printheads.
Figure 5:
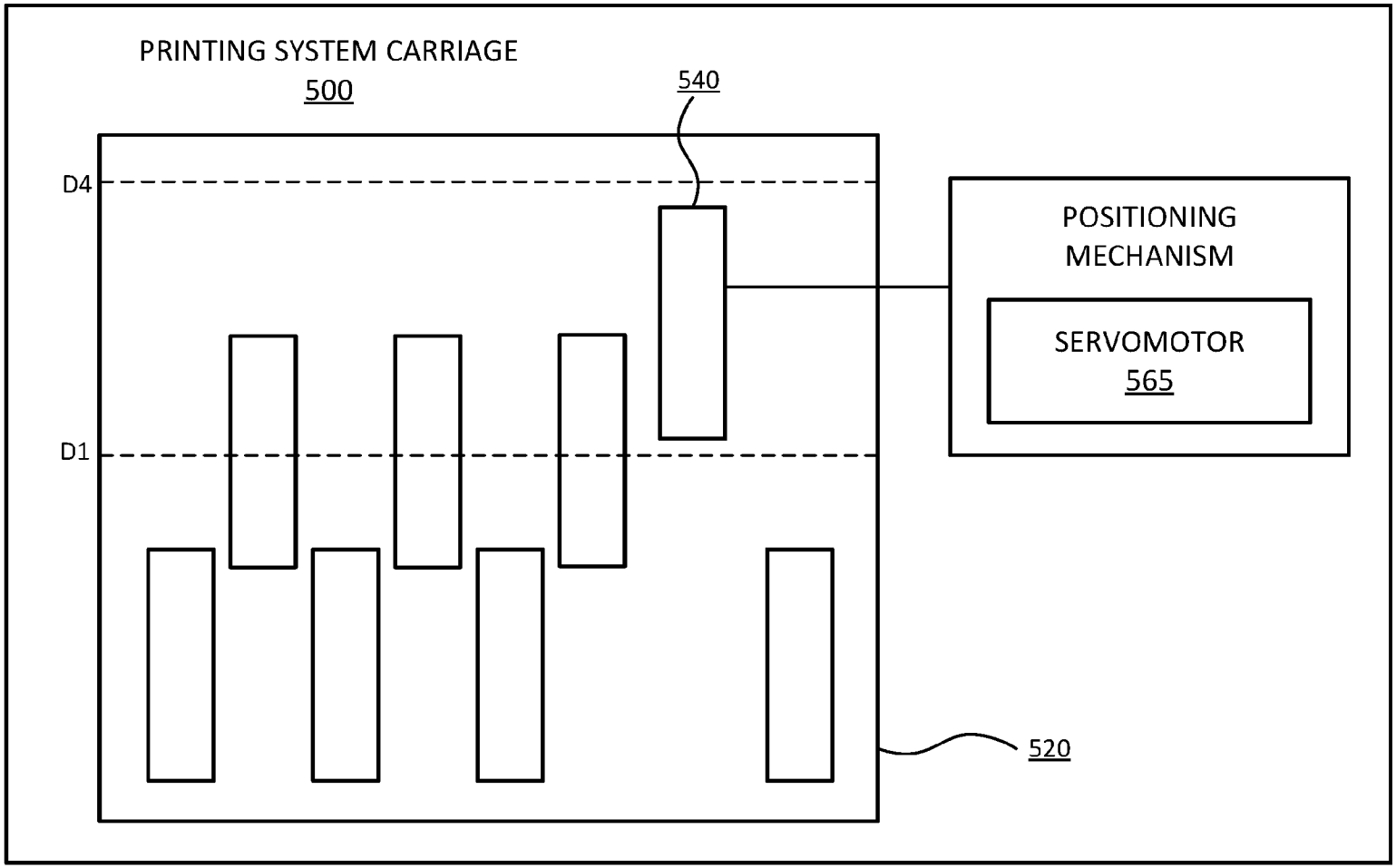
FIG. 5 is a block diagram illustrating another example of a printing system carriage comprising moveable printheads.

For simplicity, the description of FIGS. 1-5 is made based on a single moveable printhead, however there can be more than one moveable printhead in the printing system carriage without departing from the scope of the present disclosure. A plurality of examples of plurality of printheads are shown in FIGS. 2A and 2B. The positioning mechanism 160 is to move the moveable printhead from a first printhead position to a second printhead position. The positioning mechanism 160 may be any mechanism (e.g., mechanical mechanism) enabling the moveable printhead to move from the first printhead position to the second printhead position. A plurality of examples of positioning mechanism are shown in FIG. 4 and FIG. 5. In some implementations, the printing system carriage 100 may be part of a printer.

In an example, the positioning mechanism 160 may move the moveable printhead 140 from the first printhead position to the second printhead position upon receipt a triggering signal. The triggering signal may be any signal received by the printing system carriage 100. An example of print mode signal may be a change of print mode selection (e.g., change from four passes printing to six passes printing, change from six passes printing to four passes printing, and the like).

In some implementations, the printheads from the plurality of printheads 120 of the printing system carriage 100 may comprise a nozzle array comprising a plurality of nozzles controllable to eject a composition. The term nozzle may be understood as a spout at the end of a pipe, hose, or tube used to control a jet of a composition. In an example, the plurality of nozzles may be controllable by means of a controller. The term "controller" as used herein may include a series of instructions encoded on a machine-readable storage medium and executable by a single processor or a plurality of processors. Additionally, or alternatively, a controller may include one or more hardware devices including electronic circuitry, for example a digital and/or analog application-specific integrated circuit (ASIC), for implementing the functionality described herein.

In an example, the composition of a nozzle from the array of nozzles comprises white colorant. In one implementation, the composition that comprises white colorant may be a white printing fluid composition (e.g., white ink). In another example, the composition of a nozzle from the array of nozzles may comprise black colorant. In one implementation, the composition that comprises black colorant may be a black printing fluid composition (e.g., black ink). In yet another example, the composition of a nozzle from the array of nozzles may comprise colored colorant. In one implementation, the composition that comprises color colorant may be a color printing fluid composition.

In an example, the printing fluid comprises any composition used to color a surface to produce an image, text, or design. In one example, the printing fluid composition may be a liquid-based composition. In another example, the printing fluid composition may be a powder-based composition. As used herein, the term color may be understood broadly as colors may emit any wavelength ranging from about 380 nanometers (nm) to about 750 nm. In another example, the printing fluid may comprise a non-marking fluid, such as a printing overcoat agent.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

Figure 2B:
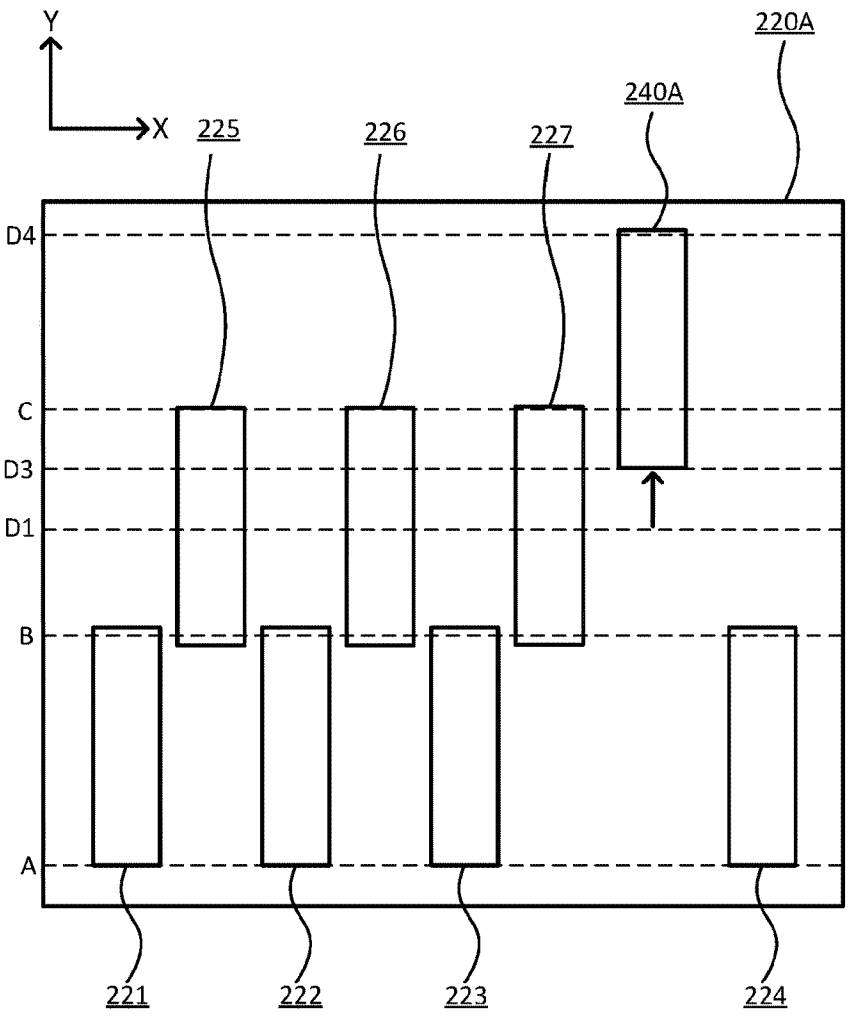
FIG. 2B is a block diagram illustrating an example of a plurality of printheads comprising moveable printheads in a second printhead position.
Figure 2A:
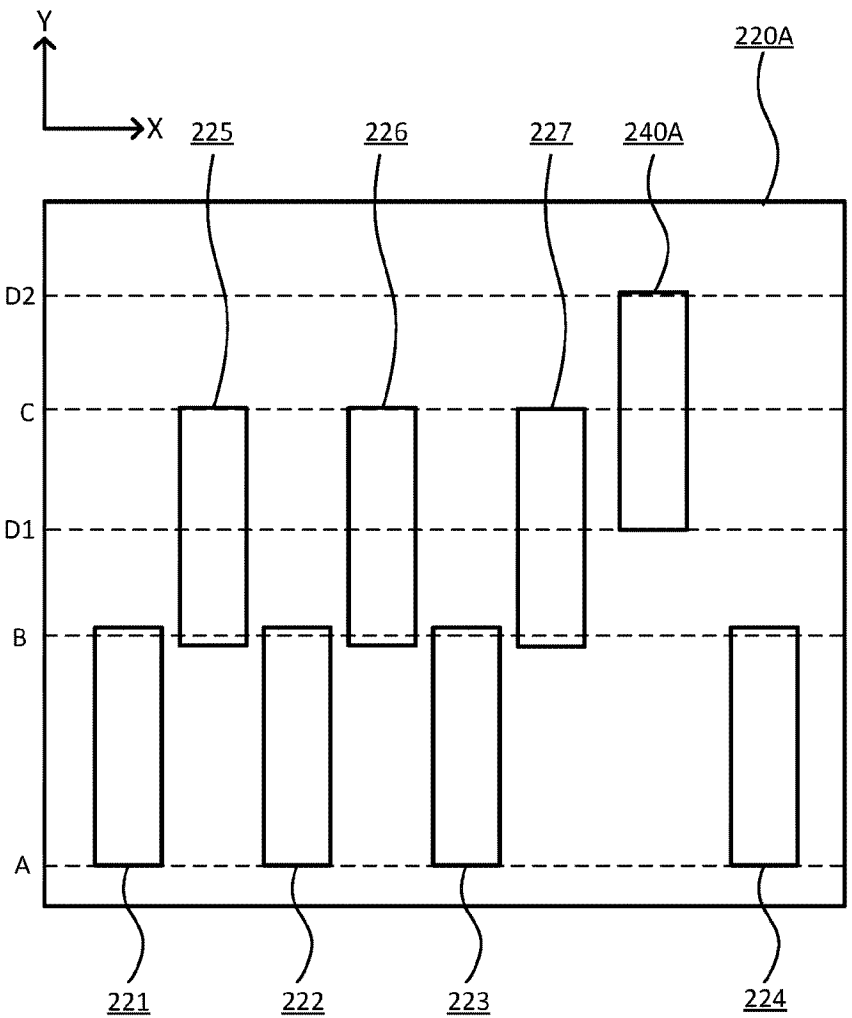
FIG. 2A is a block diagram illustrating an example of a plurality of printheads comprising moveable printheads in a first printhead position.

FIG. 2A and FIG. 2B illustrate examples of a plurality of printheads comprising moveable printheads in different positions. FIG. 2A is a block diagram illustrating an example of a plurality of printheads 220A comprising moveable printheads in a first printhead position. The plurality of printheads 220A may be the same or similar as the plurality of printheads 120 from FIG. 1. The plurality of printheads 220A may be attached to a printing system carriage (e.g., printing system carriage 100 from FIG. 1). The plurality of printheads 220A comprises eight printheads. The plurality of printheads 220A comprises a set of fixed printheads 221, 222, 223, 224, 225, 226, 227, i.e., seven fixed printheads. The fixed printheads 221-227 may be coupled to the carriage moving with the carriage. The plurality of printheads 220A may also comprise a moveable printhead 240A. The moveable printhead 240A may be moveable with respect to the other printheads from the plurality of printheads. The plurality of printheads 220A may move along the X axis with the printing system carriage. The moveable printhead 240A may be also moveable along the Y axis through different printhead positions. The media may also move along the Y axis. In this example, the moveable printhead 240A is set in a first printhead position. Axis X and axis Y may be perpendicular axis, therefore the moveable printhead may be moved from the first printhead position (e.g., FIG. 2A) to the second printhead position (e.g., FIG. 2B) perpendicularly with respect to the carriage movement. The plurality of printheads 220A may be installed in the printing system carriage in different layouts. In this example, a first subset of printheads 221-224 is installed between marking points A and B; a second subset of printheads 225-227 is installed between points B and C; and the moveable printhead in the first printhead position is installed between points D1 and D2; wherein point D1 is defined in about the middle point from points B and C, and point D2 is defined in about half of a printhead distance from point C. The distance between points A and B, B and C, and D1-D2 is about the length of a printhead. This is an example of a layout for the plurality of printheads 220A and many other layouts can be derived therefrom without departing from the scope of the present disclosure. For illustrative purposes the plurality of printheads 220A comprises eight printheads wherein one printhead is a moveable printhead 240A, however the plurality of printheads 220A may comprise a different number of printheads and more number of moveable printheads without departing from the scope of the present disclosure.

FIG. 2B is a block diagram illustrating the example of FIG. 2A wherein the movable printhead 220A of the plurality of printheads 220A has moved from a first position (as shown in FIG. 2A) to a second position (as shown in FIG. 2B). The plurality of printheads 220A may be the same or similar as the plurality of printheads 120 from FIG. 1. The moveable printhead 240A may be moveable with respect to the other printheads from the plurality of printheads. The plurality of printheads 220A may move along a carriage movement direction (for example, the X axis of FIG. 2B) with the printing system carriage while maintaining the relative position between printheads along the carriage movement direction. The moveable printhead 240A may be also moveable along the Y axis through different printhead positions. In this example, the moveable printhead 240A is set in a second printhead position. Axis X and axis Y may be perpendicular axis, therefore the moveable printhead may move from the second printhead position (e.g., FIG. 2B) to the first printhead position (e.g., FIG. 2A) along a direction parallel to the media advance direction, i.e., perpendicularly with respect to the carriage movement. The plurality of printheads 220A may be installed in the printing system carriage in different layouts. In this example, a first subset of printheads 221-224 is installed between marking points A and B; a second subset of printheads 225-227 is installed between points B and C; and the moveable printhead in the first printhead position is installed between points D3 and D4. In the example, point D3 is defined in about a third of a printhead length distance from C, and about two thirds of a printhead length distance from B; and point D4 is defined in about two thirds of a printhead length distance from point C, and a printhead length distance from point D3. The distance between points A and B, B and C, and D3-D4 is about the length of a printhead. This is an example of a plurality of printheads layout and many other layouts can be derived therefrom without departing from the scope of the present disclosure. For illustrative purposes the plurality of printheads comprises eight printheads wherein one printhead is a moveable printhead, however the plurality of printheads may comprise a different number of printheads and more number of moveable printheads without departing from the scope of the present disclosure.

In an example, the moveable printhead 240A may be located closer to an edge of the printing system carriage, along the Y axis, than the other printheads of the carriage, therefore the positioning mechanism (e.g., positioning mechanism 160 from FIG. 1) may modify the spread area of the plurality of printheads when changing from a printhead position to another printhead position. In the example, the spread area of the plurality of printheads in the first position is different to the spread area of the plurality of printheads in the second position. In the present disclosure, the spread area may be understood as the distance in the Y axis between the two furthest points comprised by the plurality of printheads 221-227 and 240A. In the examples of FIGS. 2A and 2B, the spread area of the plurality of printheads in the first printhead position (e.g., configuration of FIG. 2A) may be defined by points A and D2, being a distance of about 2.5 times the length of a printhead; and the spread area of the plurality of printheads in the second printhead position (e.g., configuration of FIG. 2B) may be defined by points A and D4, being a distance of about 2.66 times the length of a printhead. Therefore, the spread area as defined above may vary depending on the printing system printhead position.

FIG. 3A and FIG. 3B illustrate examples of a printing system carriage comprising moveable printheads in different positions. FIG. 3A is a block diagram illustrating another example of a printing system carriage 300 comprising moveable printheads in a first printhead position. The printing system carriage 300 may be the same or similar as the printing system carriage 100 from FIG. 1. The printing system carriage 300 may comprise a plurality of printheads 320A, and a positioning mechanism 360. The plurality of printheads 320A comprises a printhead 321, a printhead 322, a printhead 323, a printhead 324, a printhead 325, a printhead 326, and a printhead 327. Printheads 321-327 may be the same or similar as printheads 221-227 from FIG. 2A. The plurality of printheads 320A may also comprise a moveable printhead 340A that is movable with respect to the other printheads from the plurality of printheads 320A. The moveable printhead 340A may be the same or similar as the moveable printhead 240A from FIG. 2A. The plurality of printheads 320A are in a first printhead position configuration and may be the same or a similar configuration as the first printhead position configuration of the plurality of printheads 220A from FIG. 2A. The positioning mechanism 360 is to move the moveable printhead 340A from a first printhead position (e.g., FIG. 3A) to a second printhead configuration (e.g., FIG. 3B). The positioning mechanism 360 may be the same or similar as the positioning mechanism 160 from FIG. 1. The printing system carriage 300 may also comprise a controller 380 to generate the triggering signal, wherein the positioning mechanism 360 moves the movable printhead 340A from the first printhead position to the second printhead position upon receipt said triggering signal. The term "controller" as used herein may include a series of instructions encoded on a machine-readable storage medium and executable by a single processor or a plurality of processors. Additionally, or alternatively, a controller may include one or more hardware devices including electronic circuitry, for example a digital and/or analog application-specific integrated circuit (ASIC), for implementing the functionality described herein.

In an example, the printheads 321-327, and the moveable printhead 340A may have the same or similar printhead length. In a first configuration example, printheads 321-324 may be placed between points A1 and A3, being A2 its middle point; printheads 325-327 may be placed between points B1 and B3, being B2 its middle point. The moveable printhead 340A may be placed between C1 and C3, being C2 its middle point. Points A3 and B1 may be the same point, points B2 and C1 may be the same point, and points B3 and C2 may be the same point. This configuration may be used as a four passes printing configuration; being the first printing pass the area comprised between points A1 and A2, the second printing pass the area comprised between points A2 and A3; the third printing pass the area comprised between points B1 and B2; and the fourth printing pass the area comprised between B2 and B3. The area comprised between C2 and C3 may be used for other purposes; for example, ejecting white colorant, ejecting pre-processing agent, and/or ejecting post-processing agent. In an example, the area comprised between C2 and C3 may eject an overcoat fluid. In another example, the area comprised between C2 and C3 may eject an optimizer fluid. This is a configuration example, and other configurations may be designed therefrom without departing from the scope of the present disclosure.

At a printing operation comprising ejecting white printing fluid, white color may have the peculiarity that, in order to have the same IQ, additional passes of white printing fluid may be required compared to other printing fluids, such as black and/or colors. Therefore, having an additional area to eject white ink may enable the printing system to print using said additional passes, leading to a better IQ in the white color printed.

The controller 380 is to derive a number of passes of the carriage from a print mode selection. In an example, the print mode selection is set as a four-pass printing selection, therefore the number of passes being four passes. The plurality of printheads 320A of the example of FIG. 3A has a four-pass printing selection. As explained above, the first printing pass is the area comprised between points A1 and A2, the second printing pass is the area comprised between points A2 and A3; the third printing pass is the area comprised between points B1 and B2, and the fourth printing pass is the area comprised by B2 and B3.

The controller 380 is to divide each printhead from the plurality of printheads 320A into a plurality of segments based on the number of passes. Each number of passes may indicate how many segments each printhead from the plurality of printheads 320A should be divided. A four-pass print mode selection may indicate to divide each printhead in a multiple of two segments, for example two segments. A six-pass print mode selection may indicate to divide each printhead in a multiple of three segments, for example three segments. Following with the four passes print mode selection example, each printhead may be divided into two segments. The first segments of printheads 321-324 may be the segment defined between points A1 and A2; the second segments of printheads 321-324 may be the segment defined between points A2 and A3; the first segments of printheads 325-327 may be the segments defined between points B1 and B2; the second segments of printheads 325-327 and the first segment of the moveable printhead 340A may be the segments defined between points B2 (C1) and B3 (C2); and the second segment of the moveable printhead 340A may be the segment defined between points C2 and C3.

The controller 380 may identify that the moveable printhead segments are out of phase in respect to the other segments from the plurality of printheads. A segment may not be defined between two points (e.g., A1 and A2, A2 and A3, B1 and B2, B2 and B3, C1 and C2, and C2 and C3), the printhead that comprises said segment is out of phase. When a printhead is out of phase, it leads to big banding and therefore, a reduction of the image quality (IQ) of the printing operation.

In the event the controller 380 identifies that the moveable printhead 340A segments are out of phase with respect to the other segments from the plurality of printheads 320A, the controller 380 is to issue the triggering signal to cause the positioning mechanism 360 to move the moveable printhead from the first printhead position to the second printhead position.

FIG. 3B is a block diagram illustrating another example of a printing system carriage 300 comprising moveable printheads in a second printhead position. The printing system carriage 300 may be the same or similar as the printing system carriage 100 from FIG. 1. The printing system carriage 300 may comprise a plurality of printheads 320A, and a positioning mechanism 360. The plurality of printheads 320A comprises a printhead 321, a printhead 322, a printhead 323, a printhead 324, a printhead 325, a printhead 326, and a printhead 327. Printheads 321-327 may be the same or similar as printheads 221-227 from FIG. 2B. The plurality of printheads 320A may also comprise a moveable printhead 340A that is movable with respect to the other printheads from the plurality of printheads 320A. The moveable printhead 340A may be the same or similar as the moveable printhead 240B from FIG. 2B. The plurality of printheads 320A are in a second printhead position configuration and may be the same or a similar configuration as the second printhead position configuration of the plurality of printheads 220A from FIG. 2B. The positioning mechanism 360 is to move the moveable printhead 340A from a second printhead position (e.g., FIG. 3B) to a first printhead configuration (e.g., FIG. 3A). The positioning mechanism 360 may be the same or similar as the positioning mechanism 160 from FIG. 1. The printing system carriage 300 may also comprise a controller 380 to generate the triggering signal, wherein the positioning mechanism 360 moves the movable printhead 340A from the second printhead position to the first printhead position upon receipt said triggering signal. The term "controller" as used herein may include a series of instructions encoded on a machine-readable storage medium and executable by a single processor or a plurality of processors. Additionally, or alternatively, a controller may include one or more hardware devices including electronic circuitry, for example a digital and/or analog application-specific integrated circuit (ASIC), for implementing the functionality described herein.

In an example, the printheads 321-327, and the moveable printhead 340A may have the same or similar printhead length. In a configuration example, printheads 321-324 may be placed between points A1 and A4, being A2 at one third of printhead length distance from A1 and two thirds of printhead length distance to A4, and A3 at two thirds of printhead length distance from A1 and one third of printhead length distance to A4. Following with the configuration example, printheads 325-327 may be placed between points B1 and B4, being B2 at one third of printhead length distance from B1 and two thirds of printhead length distance to B4, and B3 at two thirds of printhead length distance from B1 and one third of printhead distance to B4. The moveable printhead 340A may be placed between C1 and C4, being C2 at one third of printhead length distance from C1 and two thirds of printhead length distance to C4, and C3 at two thirds of printhead length distance from C1 and one third of printhead distance to C4. Points A4 and B1 may be the same point, points B3 and C1 may be the same point, and points B4 and C2 may be the same point. This configuration may be used as a six passes printing configuration; being the first printing pass the area comprised between points A1 and A2, the second printing pass the area comprised between points A2 and A3; the third printing pass the area comprised between points A3 and A4; the fourth printing pass the area comprised between points B1 and B2; the fifth printing pass the area comprised between points B2 and B3; and the sixth printing pass the area comprised between points B3 (C1) and B4 (C2). The area comprised between C2 and C3, and the area comprised between C3 and C4, may be used for other purposes; for example, ejecting white colorant, ejecting pre-processing agent, and/or ejecting post-processing agent. In an example, the area comprised between C2 and C3 and/or the area comprised between C3 and C4 may eject an overcoat fluid. In another example, the area comprised between C2 and C3 and/or the area comprised between C3 and C4 may eject an optimizer fluid. This is a configuration example, and other configurations may be designed therefrom without departing from the scope of the present disclosure.

At a printing operation comprising ejecting white printing fluid, white color may have the peculiarity that, in order to have the same IQ, additional passes of white printing fluid may be required compared to other printing fluids, such as black and/or colors. Therefore, having an additional area to eject white ink may enable the printing system to print using said additional passes, leading to a better IQ in the white color printed.

The controller 380 is to derive a number of passes of the carriage from a print mode selection. In an example, the print mode selection is set as a six-pass printing selection, therefore the number of passes being six passes. The plurality of printheads 320A of the example of FIG. 3B has a six-pass printing selection. As explained above, the first printing pass is the area comprised between points A1 and A2, the second printing pass is the area comprised between points A2 and A3; the third printing pass is the area comprised between points A3 and A4; the fourth printing pass is the area comprised between points B1 and B2; the fifth printing pass is the area comprised between points B2 and B3; and the sixth printing pass is the area comprised between points B3 (C1) and B4 (C2).

The controller 380 is to divide each printhead from the plurality of printheads 320A into a plurality of segments based on the number of passes. Each number of passes may indicate how many segments each printhead from the plurality of printheads 320A should be divided. A four-pass print mode selection may indicate to divide each printhead in a multiple of two segments, for example two segments. A six-pass print mode selection may indicate to divide each printhead in a multiple of three segments, for example three segments. Following with the six passes print mode selection example, each printhead may be divided into three segments. The first segments of printheads 321-324 may be the segments defined between points A1 and A2; the second segments of printheads 321-324 may be the segments defined between points A2 and A3; the third segments of printheads 321-324 may be the segments defined between point A3 and A4; the first segments of printheads 325-327 may be the segments defined between points B1 and B2; the second segments of printheads 325-327 may be the segments defined between points B2 and B3; the third segments of printheads 325-327 and the first segment of the moveable printhead 340A may be the segments defined between points B3 (C1) and B4 (C2); the second segment of the moveable printhead 340A may be the segment defined between points C2 and C3; and the third segment of the moveable printhead 340A may be the segment defined between points C3 and C4.

The controller 380 may identify that the moveable printhead segments are out of phase in respect to the other segments from the plurality of printheads. A segment may not be defined between two points (e.g., A1 and A2, A2 and A3, A3 and A4, B1 and B2, B2 and B3, B3 and B4, C1 and C2, C2 and C3, and C3 and C4), the printhead that comprises said segment is out of phase. When a printhead is out of phase, it leads to big banding and therefore, a reduction of the image quality (IQ) of the printing.

In the event the controller 380 identifies that the moveable printhead 340A segments are out of phase with respect to the other segments from the plurality of printheads 320A, the controller 380 is to issue the triggering signal to cause the positioning mechanism 360 to move the moveable printhead from the second printhead position to the first printhead position.

FIG. 4 is a block diagram illustrating another example of a printing system carriage 400 comprising moveable printheads. The printing system carriage 400 may be similar to the printing system carriage 100 from FIG. 1. The printing system carriage 400 includes a plurality of printheads 420, and a positioning mechanism 460. The plurality of printheads 420 may be the same or similar as the plurality of printheads 420 from FIG. 1. The plurality of printheads comprises a moveable printhead 440 that is moveable with respect to the other printheads from the plurality of printheads. For simplicity a single moveable printhead is shown, however there may be more than one moveable printhead in the printing system carriage without departing from the scope of the present disclosure. A plurality of examples of plurality of printheads are shown in FIGS. 2A and 2B. The positioning mechanism 460 is to move the moveable printhead from a first printhead position to a second printhead position. The positioning mechanism 460 may be any mechanism (e.g., mechanical mechanism) enabling the moveable printhead to move from the first printhead position to the second printhead position. In some implementations, the printing system carriage 400 may be part of a printer.

In an example, the positioning mechanism 460 may comprise a pen pocket 465 moveable from the first position (e.g., configuration of FIG. 2A) to the second position (e.g., configuration of FIG. 2B). The moveable printhead may be installed on the pen pocket, therefore the positioning mechanism 460 allowing the pen pocket 465 and the moveable printhead to move together from the first printhead position to the second printhead position. In an example, the positioning mechanism 460 may also comprise an actuator that may move the pen pocket from the first printhead position to the second printhead position.

FIG. 5 is a block diagram illustrating another example of a printing system carriage 500 comprising moveable printheads. The printing system carriage 500 may be similar to the printing system carriage 100 from FIG. 1. The printing system carriage 500 includes a plurality of printheads 520, and a positioning mechanism 560. The plurality of printheads 520 may be the same or similar as the plurality of printheads 120 from FIG. 1. The plurality of printheads 520 comprises a moveable printhead 540 that is moveable with respect to the other printheads from the plurality of printheads. For simplicity a single moveable printhead is shown, however there can be more than one moveable printhead in the printing system carriage without departing from the scope of the present disclosure. A plurality of examples of plurality of printheads are shown in FIGS. 2A and 2B. The positioning mechanism 560 is to move the moveable printhead from a first printhead position to a second printhead position. The positioning mechanism 560 may be any mechanism (e.g., mechanical mechanism) enabling the moveable printhead to move from the first printhead position to the second printhead position. In some implementations, the printing system carriage 500 may be part of a printer.

In an example, the positioning mechanism 560 may comprise a servomotor 565 to move the position of the moveable printhead 440 to a position within a moving range. The boundaries of the moving range may be defined by the first printhead position (e.g., configuration of FIG. 2A) and the second printhead position (e.g., configuration of FIG. 2B). In the example, the boundaries may be defined from the lowest point of the first printhead position D1 and the highest point of the second printhead position D4. Points D1 and D4 may be the same or similar to points D1 and D4 from FIG. 2A and FIG. 2B respectively. This is an example, and many other implementations and moving ranges may be defined without departing to the scope of the present disclosure.

Figure 6:
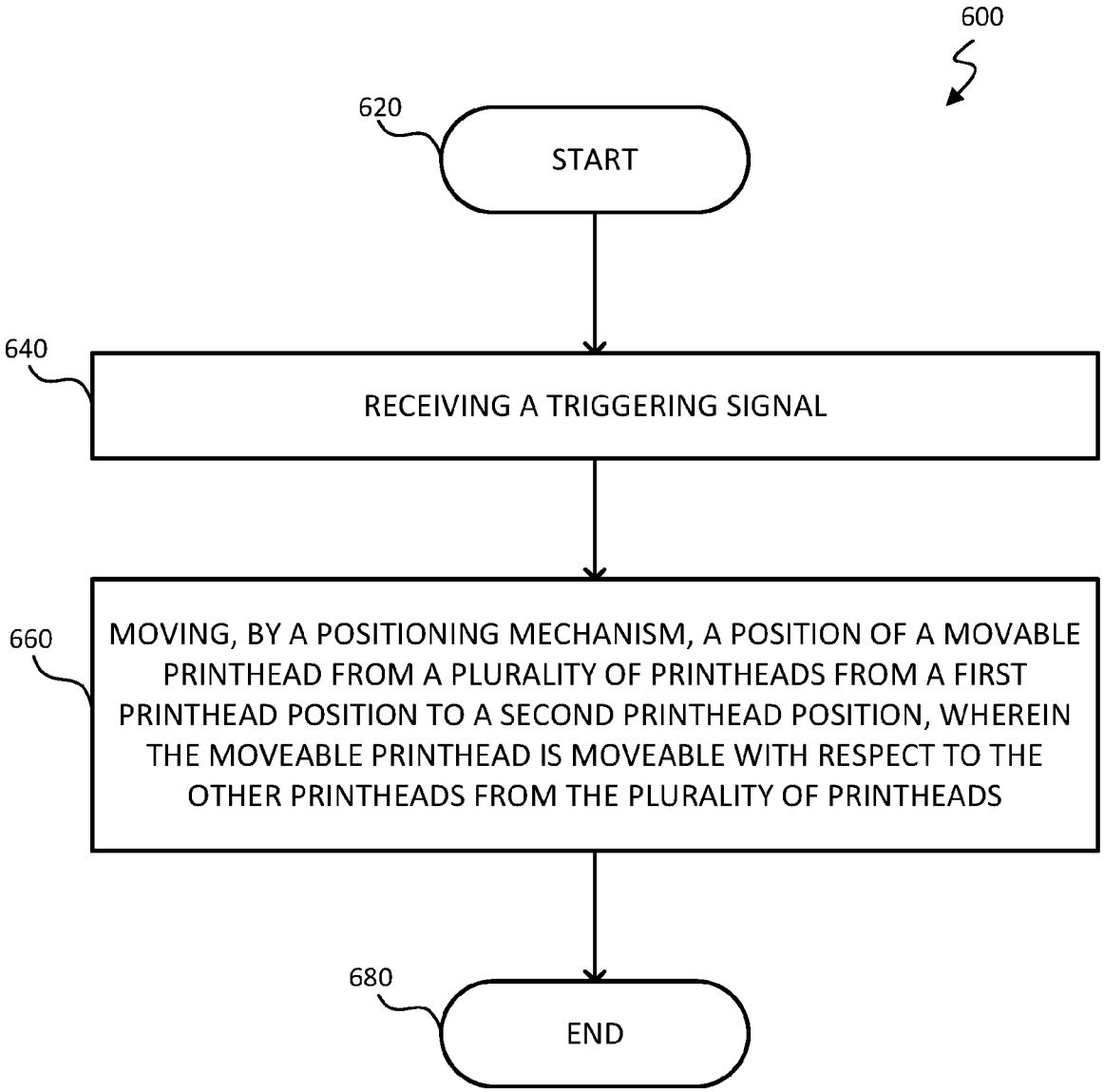
FIG. 6 is a flowchart of an example method for moving movable printheads.

FIG. 6 is a flowchart of an example method 600 for moving movable printheads according to an implementation. Method 600 may be described below as being executed or performed by a printing system carriage, such as printing system carriage 100 of FIG. 1. Various other suitable printing system carriages may be used as well, such as, for example system 300 of FIGS. 3A, and 3B; system 400 of FIG. 4; and/or system 500 of FIG. 5. Method 600 may be implemented in the form of executable instructions stored on a machine-readable storage medium and executed by a single processor or a plurality of processors of the system 100, and/or in the form of any electronic circuitry, for example digital and/or analog ASIC. In some implementations of the present disclosure, method 600 may include more or less operations than are shown in FIG. 6. In some implementations, one or more of the blocks of method 600 may, at certain times, be ongoing and/or may repeat.

The method 600 may start at block 620, and continue to block 640, where a system (e.g., printing system carriage 100 from FIG. 1) may receive a triggering signal. At block 660, the system moves, by a positioning mechanism (e.g., positioning mechanism 160 from FIG. 1), a position of a movable printhead (e.g., moveable printhead 140 from FIG. 1) from a plurality of printheads (e.g., plurality of printheads 120 from FIG. 1) from a first printhead position to a second printhead position, wherein the moveable printhead is moveable with respect to the other printheads from the plurality of printheads. At block 680, the method 600 may end.

Figure 7:
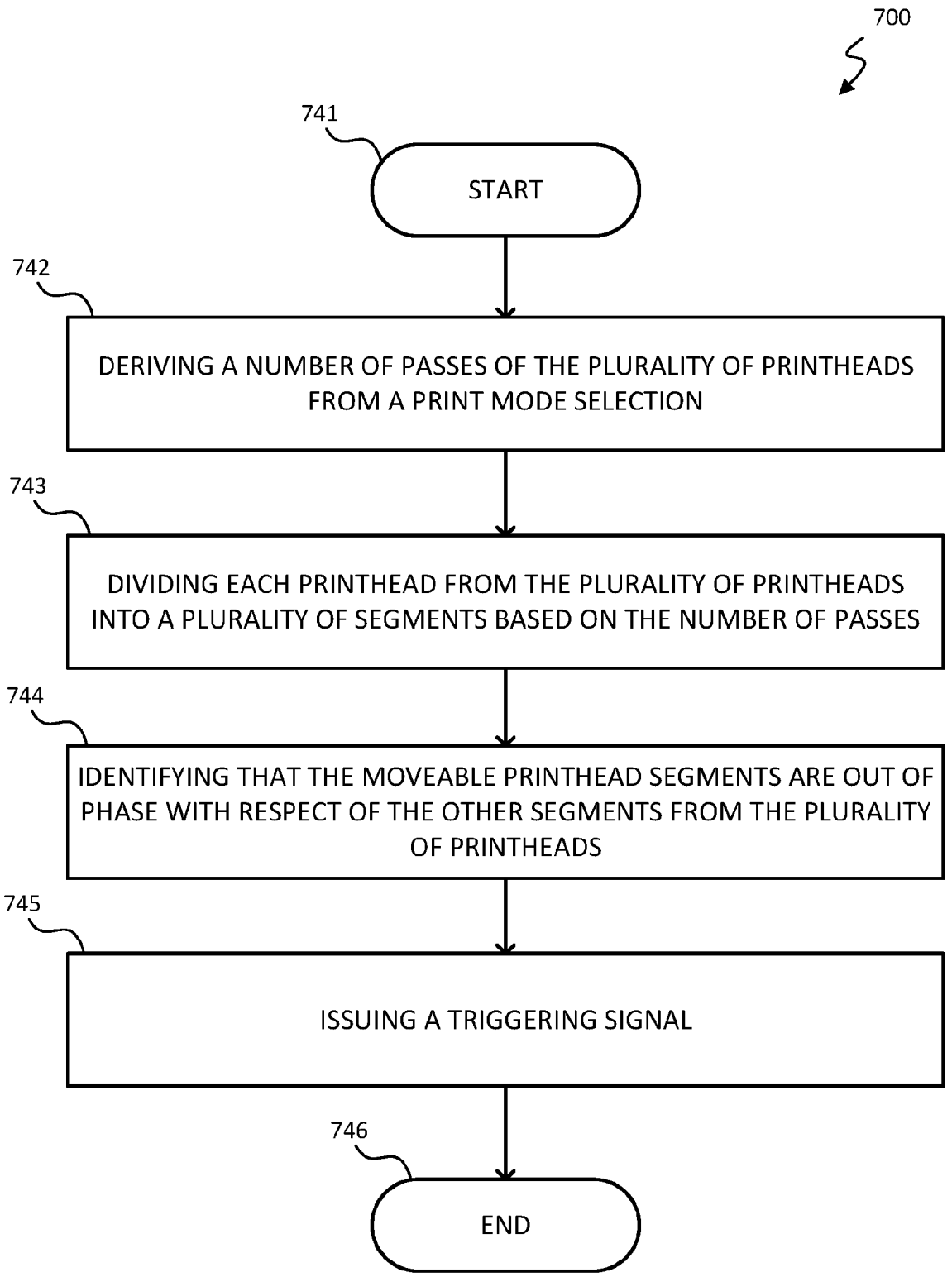
FIG. 7 is a flowchart of another example method for moving movable printheads.

FIG. 7 is a flowchart of another example method 700 for moving movable printheads. Method 700 may be a sub-method performed after block 640 from method 600 of FIG. 6. Method 700 may be described below as being executed or performed by a printing system carriage, such as printing system carriage 100 of FIG. 1. Various other suitable printing system carriages may be used as well, such as, for example system 300 of FIGS. 3A, and 3B; system 400 of FIG. 4; and/or system 500 of FIG. 5. Method 700 may be implemented in the form of executable instructions stored on a machine-readable storage medium and executed by a single processor or a plurality of processors of the system 100, and/or in the form of any electronic circuitry, for example digital and/or analog ASIC. In some implementations of the present disclosure, method 700 may include more or less operations than are shown in FIG. 7. In some implementations, one or more of the blocks of method 700 may, at certain times, be ongoing and/or may repeat.

The method 700 may start at block 741, and continue to block 742, where a controller (e.g., controller 380 from FIGS. 3A, and 3B) may derive a number of passes of the plurality of printheads (plurality of printheads 120 from FIG. 1) from a print mode selection. At block 743, the controller may divide each printhead from the plurality of printheads into a plurality of segments based on the number of passes. At block 744, the controller may identify that the moveable printhead segments are out of phase with respect of the other segments from the plurality of printheads. At block 745, the controller may issue a triggering signal. At block 746, the method 700 may end.

Figure 8:
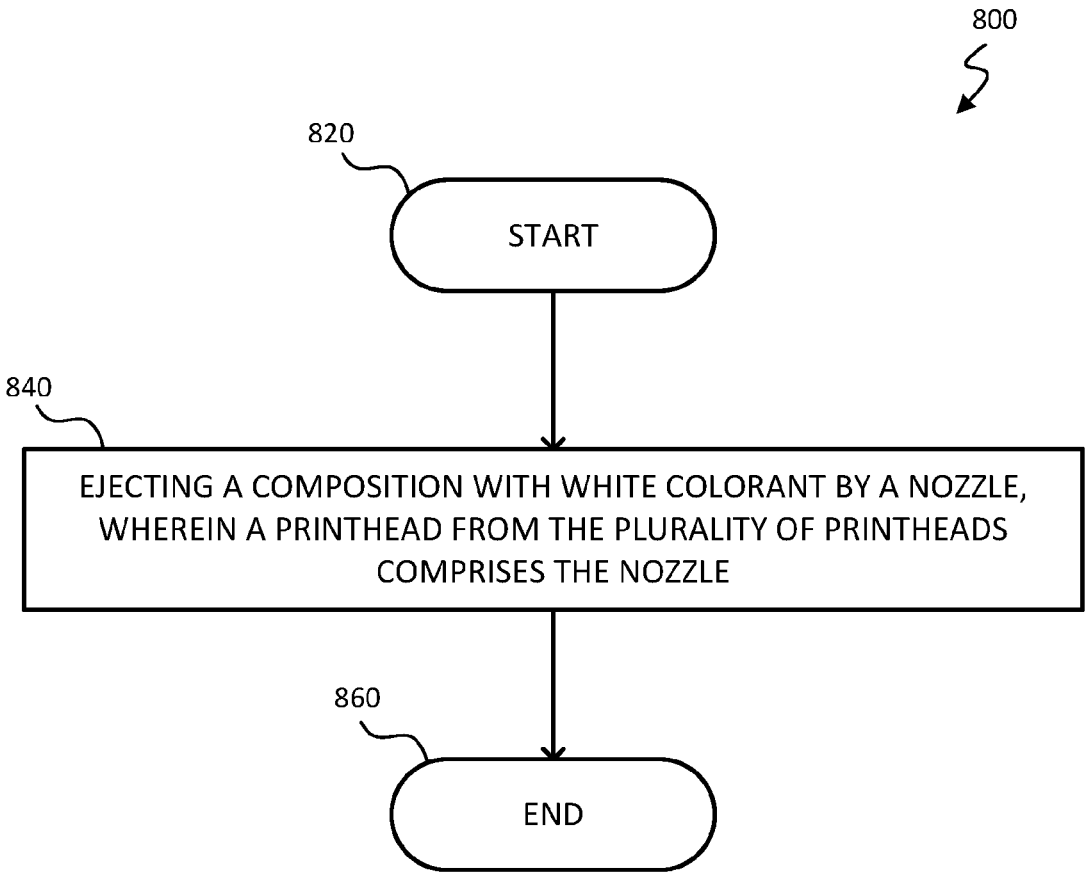
FIG. 8 is a flowchart of another example method for moving movable printheads.

FIG. 8 is a flowchart of another example method 800 for moving movable printheads. Method 800 may be a sub-method from method 600 of FIG. 6. Method 800 may be described below as being executed or performed by a printing system carriage, such as printing system carriage 100 of FIG. 1. Various other suitable printing system carriages may be used as well, such as, for example system 300 of FIGS. 3A, and 3B; system 400 of FIG. 4; and/or system 500 of FIG. 5. Method 800 may be implemented in the form of executable instructions stored on a machine-readable storage medium and executed by a single processor or a plurality of processors of the system 100, and/or in the form of any electronic circuitry, for example digital and/or analog ASIC. In some implementations of the present disclosure, method 800 may include more or less operations than are shown in FIG. 8. In some implementations, one or more of the blocks of method 800 may, at certain times, be ongoing and/or may repeat.

The method 800 may start at block 820, and continue to block 840, where a nozzle ejects a composition with white colorant, wherein a printhead from the plurality of printheads (e.g., plurality of printheads 120 from FIG. 1) comprises the nozzle. At block 860, the method 800 may end.

Figure 9:
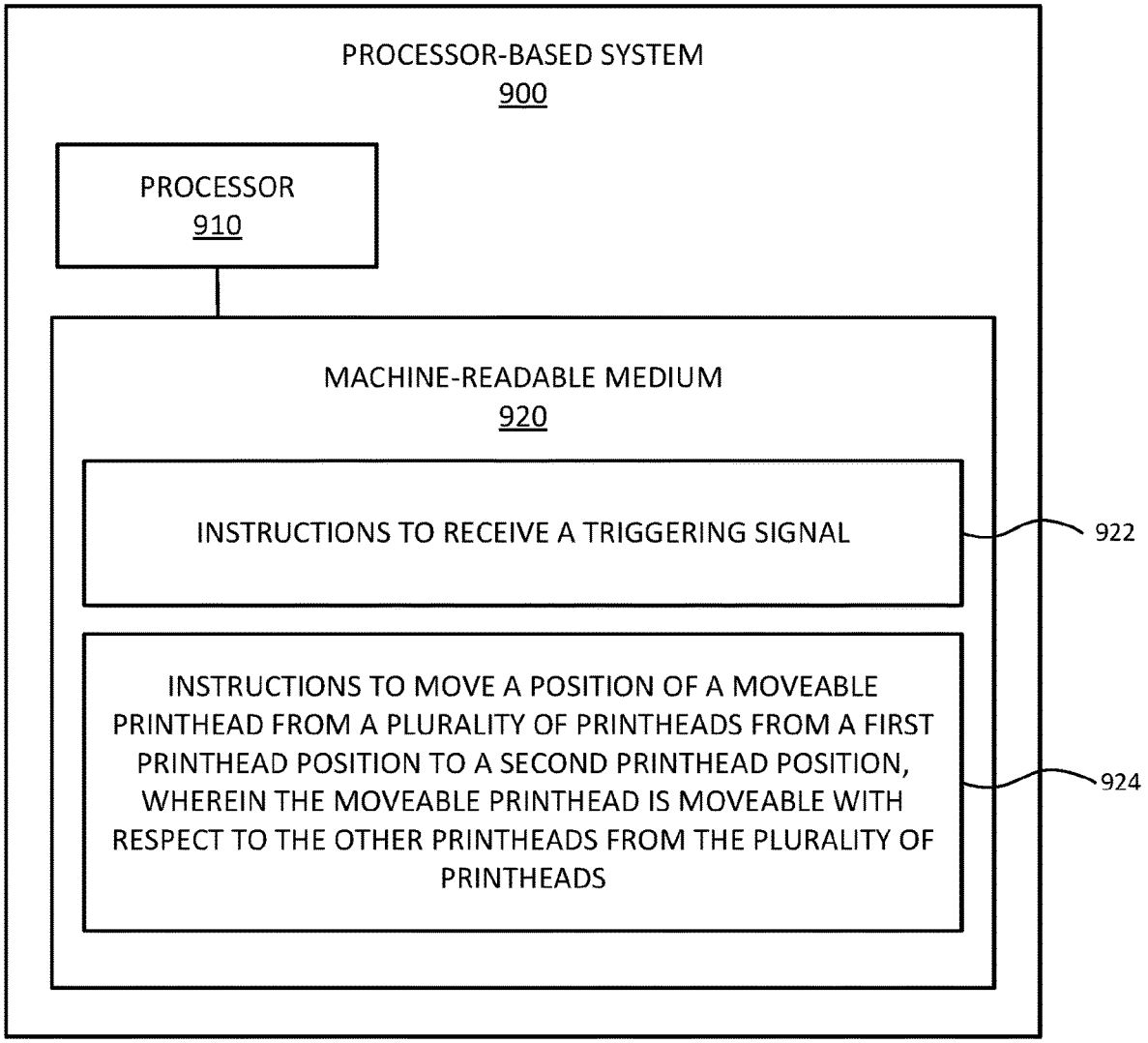
FIG. 9 is a block diagram illustrating an example of a processor-based system to move moveable printheads.

FIG. 9 is a block diagram illustrating an example of a processor-based system 900 to move moveable printheads. In some implementations, the system 900 may be or may form part of a printing device, such as a printer. In some implementations, the system 900 is a processor-based system and may include a processor 910 coupled to a machine-readable medium 920. The processor 910 may include a single-core processor, a multi-core processor, an application-specific integrated circuit (ASIC), a field programmable gate array (FPGA), and/or any other hardware device suitable for retrieval and/or execution of instructions from the machine-readable medium 920 (e.g., instructions 922, and 924) to perform functions related to various examples. Additionally, or alternatively, the processor 910 may include electronic circuitry for performing the functionality described herein, including the functionality of instructions 922, and/or 924. With respect of the executable instructions represented as boxes in FIG. 9, it should be understood that part or all of the executable instructions and/or electronic circuits included within one box may, in alternative implementations, be included in a different box shown in the figures or in a different box not shown.

The machine-readable medium 920 may be any medium suitable for storing executable instructions, such as a random-access memory (RAM), electrically erasable programmable read-only memory (EEPROM), flash memory, hard disk drives, optical disks, and the like. In some example implementations, the machine-readable medium 920 may be a tangible, non-transitory medium, where the term "non-transitory" does not encompass transitory propagating signals. The machine-readable medium 920 may be disposed within the processor-based system 900, as shown in FIG. 9, in which case the executable instructions may be deemed "installed" on the system 900. Alternatively, the machine-readable medium 920 may be a portable (e.g., external) storage medium, for example, that allows system 900 to remotely execute the instructions or download the instructions from the storage medium. In this case, the executable instructions may be part of an "installation package". As described further herein below, the machine-readable medium may be encoded with a set of executable instructions 922-924.

Instructions 922, when executed by the processor 910, may cause the processor 910 to receive a triggering signal. Instructions 924, when executed by the processor 910, may cause the processor 910 to move a position of a moveable printhead (e.g., moveable printhead 140 from FIG. 1) from a plurality of printheads (plurality of printheads 120 from FIG. 1) from a first printhead position to a second printhead position, wherein the moveable printhead is moveable with respect to the other printheads from the plurality of printheads.

The machine-readable medium 920 may include further instructions. For example, instructions that when executed by the processor 910, may cause the processor 910 to derive a number of passes of the plurality of printheads from a print mode selection; and/or instructions that when executed by the processor 910, may cause the processor 910 to divide each printhead from the plurality of printheads into a plurality of segments based on the number of passes; and/or instructions that when executed by the processor 910, may cause the processor 910 to identify that the moveable printhead segments are out of phase with respect of the other segments from the plurality of segments; and/or instructions that when executed by the processor 910, may cause the processor 910 to issue a triggering signal.

The machine-readable medium 920 may include further instructions. For example, instructions that when executed by the processor 910, may cause the processor 910 to eject a composition with white colorant by a nozzle, wherein a printhead from the plurality of printheads comprises the nozzle.

The above examples may be implemented by hardware, or software in combination with hardware. For example, the various methods, processes and functional modules described herein may be implemented by a physical processor (the term processor is to be implemented broadly to include CPU, processing module, ASIC, logic module, or programmable gate array, etc.). The processes, methods and functional modules may all be performed by a single processor or split between several processors; reference in this disclosure or the claims to a "processor" should thus be interpreted to mean "at least one processor". The processes, method and functional modules are implemented as machine-readable instructions executable by at least one processor, hardware logic circuitry of the at least one processors, or a combination thereof.

The drawings in the examples of the present disclosure are some examples. It should be noted that some units and functions of the procedure are not necessarily essential for implementing the present disclosure. The units may be combined into one unit or further divided into multiple sub-units. What has been described and illustrated herein is an example of the disclosure along with some of its variations. The terms, descriptions and figures used herein are set forth by way of illustration. Many variations are possible within the scope of the disclosure, which is intended to be defined by the following claims and their equivalents.

What it is claimed is:

1. A printing system carriage comprising:

a plurality of printheads comprising a moveable printhead that is movable with respect to other printheads of the plurality of printheads; and a position adjuster to move the movable printhead from a first printhead position to a second printhead position based on a triggering signal, the movable printhead moved perpendicular with respect to a carriage movement axis and parallel to a media advancement axis that is perpendicular to the carriage movement axis, and the triggering signal indicating a pass number change from a first pass number to a second pass number, wherein the first pass number divides each of the plurality of printheads into a first plurality of segments and the second pass number divides each of the plurality of printheads into a second plurality of segments different from the first plurality of segments.

2. The printing system carriage of claim 1, further comprising a controller to:

derive a number of passes of the carriage based on a print mode selection;

divide each printhead of the plurality of printheads into the first plurality of segments based on the number of passes;

identify that the first plurality of segments of the moveable printhead are out of phase with respect to segments of the other printheads; and issue the triggering signal to correct out-of-phase alignment of the first plurality of segments of the moveable printhead with respect to the segments of the other printheads, the out-of-phase alignment corrected to correspond to the second pass number.

3. The printing system carriage of claim 2, wherein the first plurality of segments are a multiple of two.

4. The printing system carriage of claim 2, wherein the first plurality of segments are a multiple of three.

5. The printing system carriage of claim 1, wherein a spread area of the plurality of printheads in the first printhead position is different than a spread area of the plurality of printheads in the second printhead position.

6. The printing system carriage of claim 1, wherein each printhead comprises a nozzle array comprises a plurality of nozzles controllable to eject a composition.

7. The printing system carriage of claim 6, wherein the composition ejected by a nozzle of the nozzle array comprises white colorant.

8. The printing system carriage of claim 1, wherein the position adjuster comprises a pen pocket movable from the first printhead position to the second printhead position, and the moveable printhead is installed on the pen pocket.

9. The printing system carriage of claim 1, wherein the position adjuster comprises a servomotor to move the movable printhead to a position within a moving range, boundaries of the moving range being defined by the first printhead position and the second printhead position.

10. The printing system carriage of claim 1, further comprising a controller to:

identify that the first plurality of segments of the movable printhead corresponding to the first pass number are out of phase with respect to segments of the other printheads for the first pass number; and responsively issue the triggering signal to correct out-of-phase alignment of the first plurality of segments of the moveable printhead with respect to the segments of the other printheads, the out-of-phase alignment corrected to correspond to the second pass number.

11. The printing system carriage of claim 1, further comprising a controller to issue the triggering signal in response to determining that segments of the movable printhead are out of phase with respect to segments of the other printheads.

12. The printing system carriage of claim 1, wherein the position adjuster is to move the moveable printhead to reduce a degree to which the movable printhead is out of phase with the second plurality of segments of the plurality of printheads when the first pass number is changed to the second pass number.

13. A method comprising:

receiving a triggering signal; and moving, by a position adjuster, a movable printhead of a plurality of printheads from a first printhead position to a second printhead position based on a triggering signal indicating a pass number change from a first pass number to a second pass number, wherein the first pass number divides each of the plurality of printheads into a first plurality of segments and the second pass number divides each of the plurality of printheads into a second plurality of segments different from the first plurality of segments, wherein the movable printhead is moved perpendicular with respect to a carriage movement axis and parallel to a media advancement axis that is perpendicular to the carriage movement axis, and wherein the moveable printhead is moved with respect to other printheads of the plurality of printheads.

14. The method of claim 13, further comprising:

deriving a number of passes of the plurality of printheads based on a print mode selection;

dividing each printhead of the plurality of printheads into the first plurality of segments based on the number of passes;

identifying that the segments of the moveable printhead are out of phase with respect to segments of the other printheads; and issuing a triggering signal to correct out-of-phase alignment of the first plurality of segments of the moveable printhead with respect to the segments of the other printheads, the out-of-phase alignment corrected to correspond to the second pass number.

15. The method, of claim 13 wherein the movable printhead is to eject white ink.

16. The method of claim 13, further comprising:

identifying that the first plurality of segments of the movable printhead corresponding to the first pass number are out of phase with respect to segments of the other printheads for the first pass number; and responsively issuing the triggering signal to correct out-of-phase alignment of the first plurality of segments of the moveable printhead with respect to the segments of the other printheads, the out-of-phase alignment corrected to correspond to the second pass number.

17. The method of claim 13, further comprising:

issuing the triggering signal in response to determining that segments of the movable printhead are out of phase with respect to segments of the other printhead.

18. A non-transitory machine readable medium storing instructions executable by a processor to perform processing comprising:

receiving a triggering signal indicating a pass number change from a first pass number to a second pass number, the first pass number dividing each of a plurality of printheads into a first plurality of segments and the second pass number divides each of the plurality of printheads into a second plurality of segments different from the first plurality of segments; and moving a movable printhead of the plurality of printheads from a first printhead position to a second printhead position, wherein the movable printhead is moved perpendicular with respect to a carriage movement axis and parallel to a media advancement axis that is perpendicular to the carriage movement axis, and wherein the moveable printhead is moved with respect to other printheads of the plurality of printheads.

19. The non-transitory machine readable medium of claim 18, wherein the processing further comprises:

identifying that the first plurality of segments of the movable printhead corresponding to the first pass number are out of phase with respect to segments of the other printheads for the first pass number; and responsively issuing the triggering signal to correct out-of-phase alignment of the first plurality of segments of the moveable printhead with respect to the segments of the other printheads, the out-of-phase alignment corrected to correspond to the second pass number.

20. The non-transitory machine readable medium of claim 18, wherein the processing further comprises:

issuing the triggering signal in response to determining that segments of the movable printhead are out of phase with respect to segments of the other printhead.

* * * * *